United States Patent [19]

Anderson

[11] 4,254,980

[45] Mar. 10, 1981

[54] TROWEL DEVICE

[76] Inventor: Thomas A. Anderson, 936 Highland Park Dr., Baton Rouge, La. 70808

[21] Appl. No.: 95,770

[22] Filed: Nov. 19, 1979

[51] Int. Cl.[3] ..... B05C 11/04

[52] U.S. Cl. ..... 294/15; 294/3.5; 15/235.6

[58] Field of Search ..... 294/15, 3.5; 15/235.4, 15/235.5, 235.6, 235.7, 235.8; D8/10, 45

[56] References Cited

U.S. PATENT DOCUMENTS

| | | | |
|---|---|---|---|
| 1,609,704 | 12/1926 | Ellis | 15/235.4 |
| 2,912,851 | 11/1959 | Karnes | 15/235.5 |
| 3,916,472 | 11/1975 | Carder | 15/235.6 |

*Primary Examiner*—James B. Marbert

*Attorney, Agent, or Firm*—Roy, Kiesel, Patterson & McKay

[57] ABSTRACT

A trowel for spreading glue on floor surfaces having a flat plate to which is attached a handle, above and back of which is a grip pressure release assembly.

1 Claim, 5 Drawing Figures

TROWEL DEVICE

BACKGROUND OF THE INVENTION

1. Field of the Invention.

This inventions relates in general to trowels and, more particularly, to trowels used for spreading glue on floor surfaces.

2. Prior Art.

Prior to installing many types of floor coverings, such as tile, carpet, etc., it is necessary to prepare the floor surface by spreading glue evenly over the surface. At present, this is accomplished by conventional trowels. These trowels are constructed of a flat metal plate blade having a toothed edge and a handle extended above and parallel to the plate by a support welded to the plate. In the more recent designs, the toothed edge blade is replaceably attached to the plate to avoid throwing away the entire trowel when the teeth are worn down.

Utilization of such trowels results in painful blisters and callouses being formed in the user's palm. Once the blisters are formed, the carpet layer is slowed down or stopped from further work, depending on the amount of pain experienced.

Another problem with existing trowels is the replacement toothed edge blades do not allow for proper filing as may be desired by the user once they have been worn down several times.

SUMMARY OF THE INVENTION

Therefore, it is an object of this invention to provide a trowel device for spreading glue on floor surfaces.

Another object of this invention is to provide a trowel device for spreading glue on floor surfaces which prevents blisters and callouses from forming in the user's palms.

Still another object of this invention is to provide a replacement blade that can have its toothed edge refiled more often.

Other objects and advantages of this invention shall become apparent from the ensuing descriptions of the invention.

Accordingly, a trowel device for spreading glue on floor surfaces is provided comprising a flat metal plate having a toothed edge, a handle arm positioned above and parallel to the plate by a support structure on which the user's palm rests and a grip pressure release assembly having an arm means positioned above and back of the handle in contact with the back of the user's hand, the arm means being attached to the support structure.

PREFERRED EMBODIMENTS OF THE INVENTION

Figure 1:
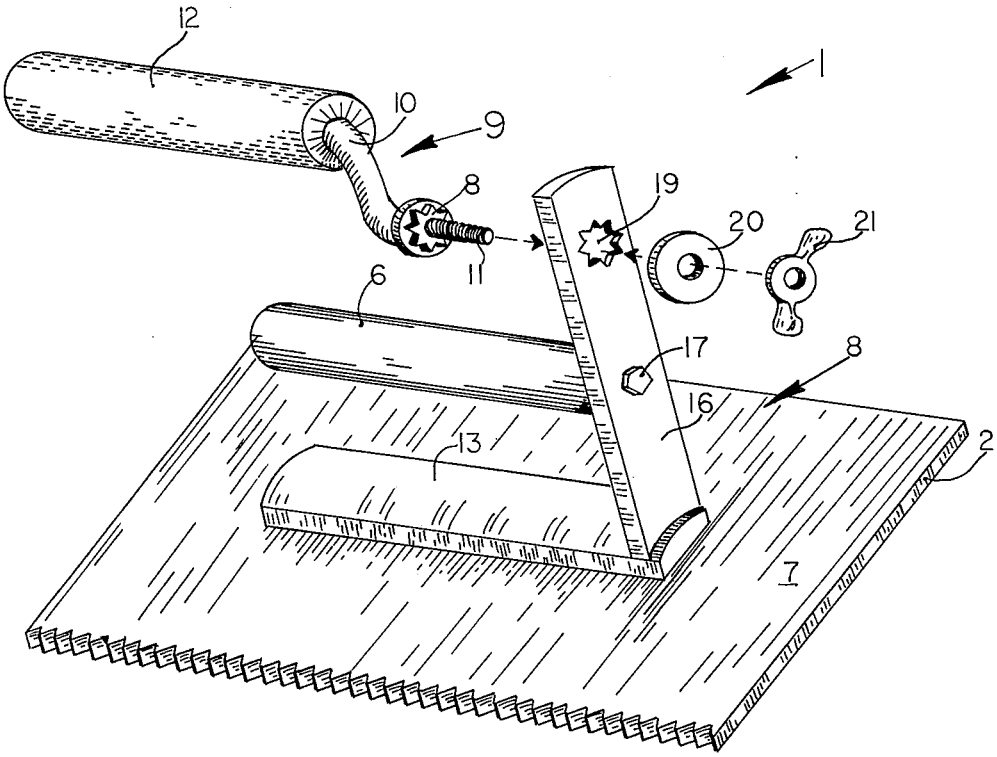
FIG. 1 is an exploded three dimensional view of one embodiment of the invention.

Referring to the figures, the trowel device, denoted generally by the numeral 1, comprises a flat metal plate blade 2 having at least one toothed edge 3 for evenly spreading glue 4 on a floor surface 5. Attached to blade 2 is a handle bar 6 which is positioned above and parallel to blade surface 7 by support structure assembly, denoted generally by the numeral 8.

Positioned above and behind handle bar 6 with respect to edge 3 is a grip pressure release assembly, denoted generally by the numeral 9. Assembly 9 comprises rod 10 offset, but preferably parallel to threaded end 11 as more clearly seen in FIGS. 1 and 2. In a preferred embodiment, padding 12 wraps around and is attached to rod 10.

Support structure assembly 8 comprises plate member 13 that is attached to blade 2 by screws 14 (See FIGS. 2 and 4) which are preferably countersunk to provide a smooth surface 15 on the bottom of blade 2. Extending perpendicularly from one end of plate member 13 is metal member 16. Handle bar 6 is perpendicularly attached to member 13 by screw 17.

In a preferred embodiment seen in FIG. 1, aligning piece 18 is rigidly fixed to threaded end 11 to mate with opening 19 in metal member 16 wherein opening 19 is shaped to match aligning piece 18. Washer 20 and wing nut 21 then are screwed on end 11 to securely hold assembly 9 in the desired position.

Figure 3:
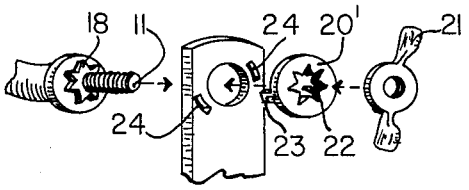
FIG. 3 is an exploded view of a preferred means to attach the grip pressure release arm means to the support structure.

In an alternate preferred embodiment (See FIG. 3), washer 20' is provided with opening 22 shaped to match aligning piece 18 and studs 23 that fit into slots 24 of metal member 16 to fixedly position washer 20' when wing nut 21 is screwed on end 11.

Figure 2:
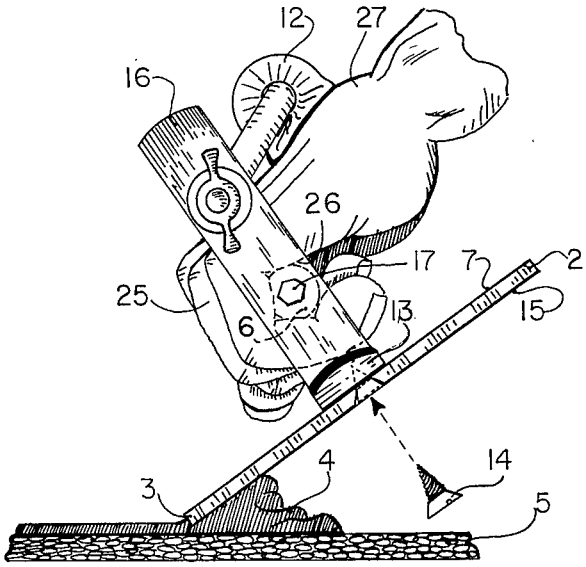
FIG. 2 is a side view of one embodiment of the invention illustrating the positioning of the user's hand during use.

In operation, glue 4 is placed on the floor 5. Then blade surface 15 near edge 3 and trowel device 1 is gripped by hand 25 whereby the palm 26 rests on bar 6 and padding 12 presses against the back 27 of hand 25 as shown in FIG. 2. The trowel is tilted and blade edge 3 pressed against floor 5 in sweeping motions, spreading glue 4 as it does so. In this manner, most of the frictional pressure between the palm 26 and bar 6 is removed.

Figure 4:
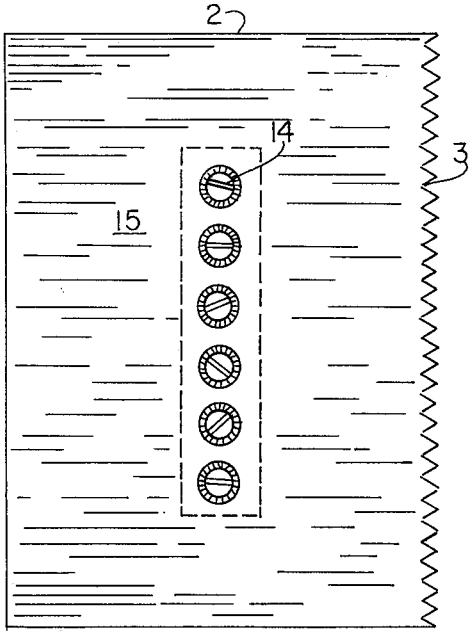
FIG. 4 is a bottom view of the flat metal plate illustrating countersink screw and attaching the support structure to the metal plate.
Figure 5:
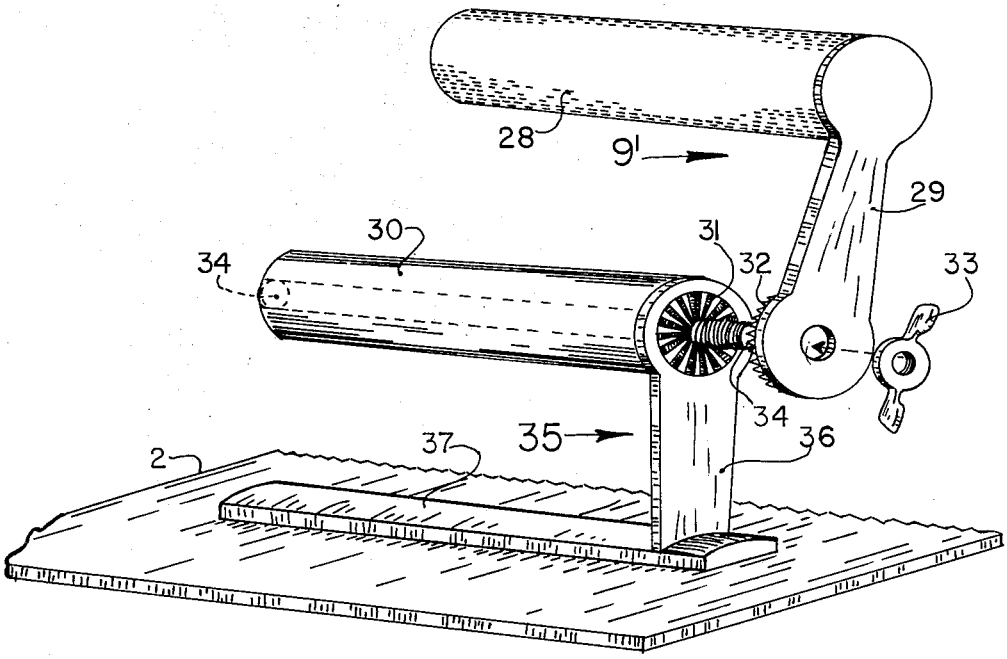
FIG. 5 is a three dimensional view of an alternate embodiment of this invention illustrating another method to attach a grip pressure release assembly.

In an alternate embodiment illustrated in FIG. 5, grip pressure release assembly 9' comprises padded rod member 28 attached perpendicularly to position arm 29 that in turn is perpendicularly connected to padded grip member 30. Rod member 28 can be positioned as desired and locked into place by pressing corresponding serrated surfaces 31 and 32 together and holding in position by screwing wing nut 33 onto threaded shaft 34, which extend through member 30 and its support structure 35. In this embodiment, serrated surface 31 forms part of upwardly extending support tub 36 which is attached at its lower end to plate member 37. Plate member 37 in turn is preferably screwed to blade 2 as shown in FIG. 4.

There are, of course, many obvious alternate embodiments not specifically shown but which are intended to be included within the scope of this invention as defined by the following Claims.

What I claim is:

1. A trowel device for spreading glue on a floor surface comprising:

(a) a glue spreading metal plate blade having at least one toothed edge and flat bottom surface;

(b) a support assembly comprising a member perpendicularly attached to said plate opposite said flat bottom surface;

(c) a handle arm attached to said member above and parallel to said blade, on which a hand palm can rest; and (d) a grip pressure release assembly attached to said support structure comprising an arm means positioned above and, with respect to said toothed edge, back of said handle arm to be in contact with the back of the hand of a user; said arm means having an offset and parallel threaded end section, alignment means attached to said threaded end section and having multiple aligning positioning members, and wherein said support structure member having an opening matingly matched to said alignment means and through which said alignment means can pass in rotatable fixed position.

* * * * *